United States Patent [19]

Collins

[11] 4,171,268

[45] Oct. 16, 1979

[54] LUBRICANT COMPOSITIONS CONTAINING ZIRCONYL SOAPS

[75] Inventor: Albert V. Collins, Fairview Park, Ohio

[73] Assignee: Mooney Chemicals, Inc., Cleveland, Ohio

[21] Appl. No.: 908,079

[22] Filed: May 22, 1978

[51] Int. Cl.[2] ..... C10M 1/48; C10M 1/42; C10M 1/38; C10M 1/26

[52] U.S. Cl. ..... 252/32.7 E; 252/33.6; 252/35

[58] Field of Search ..... 252/32.7 E, 35, 33.6

[56] References Cited

U.S. PATENT DOCUMENTS

| | | | |
|---|---|---|---|
| 2,681,922 | 6/1954 | Balthis | 252/35 |
| 2,802,847 | 8/1957 | Blumenthal | 252/35 |
| 3,017,361 | 1/1962 | Morris et al. | 252/35 |
| 3,030,320 | 4/1962 | Haslam | 252/35 |
| 3,238,130 | 3/1966 | Matson | 252/32.7 E |
| 3,318,808 | 5/1967 | Plemich et al. | 252/32.7 E |
| 3,513,094 | 5/1970 | Farmer et al. | 252/32.7 E |

*Primary Examiner*—Irving Vaughn
*Attorney, Agent, or Firm*—Maky, Renner, Otto & Boisselle

[57] ABSTRACT

Compositions useful as lubricants comprising a major proportion of an oleaginous liquid of lubricating viscosity and an additive mixture of (a) a zirconium salt of a carboxylic acid or mixture of carboxylic acids, and (b) at least one oil-soluble sulfur-containing extreme pressure agent containing up to about 25% combined sulfur are described. Such compositions are useful as extreme pressure lubricants such as gear lubricants adapted for heavy duty service.

22 Claims, No Drawings

LUBRICANT COMPOSITIONS CONTAINING ZIRCONYL SOAPS

BACKGROUND OF THE INVENTION

The invention of this application relates to additive concentrates or lubricants, and more particularly, to compositions which are useful as lubricants and functional fluids which are useful particularly in environments characterized by high pressures and rubbing surfaces.

The design of mechanical devices including internal combustion engines often results in high pressures on rubbing surfaces, and it appears that the continuing changes in the design of such mechanical devices results in even greater increase in the extreme pressures which are generated within the devices. Accordingly, there is a continuing need for improved lubricating compositions of the extreme pressure type which are suitable for lubricating the surfaces which are subject to these extreme pressures. For example, hypoid type gears employed in automotive differentials impose an axial component of sliding upon the radial sliding of oridinary gear teeth causing a sliding velocity and total temperature which is much greater than that of ordinary gears. The compositions which are used as lubricants for such gears are called EP lubricants or extreme pressure lubricants.

It has been known for some time that compounds containing active sulfur or sulfur and chlorine, when used in a lubricant will decrease the wear and tear of the machine parts. It has been suggested that the addition of small amounts of sulfur or sulfur-containing compounds to lubricating oils or greases results in the formation of surface sulfides and dense layers of oriented molecules adsorbed on the surface of the lubricated parts thereby decreasing the wear and tear of the part. Although elemental sulfur is very effective, the endurance of the surface sulfides formed is relatively low. The sulfur-containing compounds which are incorporated in lubricants are less reactive as far as the sulfide formation is concerned, but they are capable of forming multi-layered films on the metal surfaces which have self-regenerative powers. The over-all effect is that the sulfur-containing compounds increase the anti-wear and anti-friction properties of the lubricants to a high degree.

Since heat is developed under high pressures, it is necessary that the films which are deposited on the moving parts be resistant to rupture under high pressure and high temperatures. The use by themselves of elemental sulfur and sulfur-containing compounds in substantial amounts in lubricants for the purpose of imparting extreme pressure characteristics has not been entirely satisfactory since it is necessary that the sulfur be present in an active form which is also corrosive.

The use of lead soaps such as lead naphthenate in mineral lubricating oils has been effective in producing lubricants having improved extreme pressure properties. The use of such soaps has been proposed either alone or in combination with elemental sulfur or organic compounds containing combined sulfur and/or halogen. U.S. Pat. No. 3,702,822 describes an extreme pressure lubricant additive which is the reaction product of a lead compound such as lead oxide with a carboxylic acid and an alcohol. Other heavy metal soaps have been suggested for use in lubricants in place of the various lead soaps.

The extreme pressure requirements for lubricants have steadily risen to the point where the performance of the available lubricants may not always be acceptable. Moreover, because of the toxicological and environmental problems, it has become highly desirable to provide extreme pressure lubricants which are lead-free but which will supply a dependable service associated with the lead lubricants.

SUMMARY OF THE INVENTION

In accordance with the present invention, an extreme pressure lubricant of superior quality is provided. The lubricating composition comprises a major proportion of oleaginous liquid of lubricating viscosity, and a minor amount of an additive composition comprising a mixture of (a) a zirconium salt of a carboxylic acid or mixture of carboxylic acids, and (b) at least one oil-soluble sulfur-containing extreme pressure agent containing up to about 25% combined sulfur.

Additive concentrate compositions containing such zirconium salts and sulfur-containing extreme pressure agents also are described.

DESCRIPTION OF THE PREFERRED EMBODIMENTS

The compositions of the invention are useful as lubricating compositions and also as functional fluids. Functional fluids as used in this application include fluids which are involved in or facilitate the transmission of energy such as a lubricant, a hydraulic fluid, an automatic transmission fluid, heat exchange medium, etc. Accordingly, the composition of the invention will comprise a major proportion of an oleaginous liquid of lubricating viscosity and a minor amount of an additive composition which comprises a mixture of a zirconium salt and at least one oil-soluble sulfur-containing extreme pressure agent as defined more fully below.

The oleaginous liquids which are useful in the preparation of the compositions of the invention are liquids of lubricating viscosity and these include natural and synthetic oils, and mixes thereof, especially oils of the type which are useful as crankcase lubricating oils for spark-ignited and compression-ignited internal combustion engines, including automobile and truck engines, 2-cycle engines, aviation piston engines, marine and railroad diesel engines, as well as gas engines, stationary car engines and turbines. Base liquids for automatic transmission fluids, transaxle lubricants, gear lubricants, metal-working lubricants, hydraulic fluids and other lubricating oil and grease compositions also are useful for this purpose.

Natural oils include animal oils and vegetable oils (e.g. caster oil, lard oil) as well as liquid petroleum oils and solvent-treated or acid-treated mineral lubricating oils of the paraffinic, naphthenic or mixed paraffinic-naphthenic types; such mineral oils are preferred. Oils of lubricating viscosity derived from coal or shale are also useful.

Synthetic lubricating oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc. and mixtures thereof); alkylbenzenes (e.g. dodecylbenzenes, tetradecylbenzenes, dinonylbenzenes, di-(2-ethylhexyl)benzenes, etc.); polyphenyls (e.g. biphenyls, terphenyls, alkylated polyphenyls, etc.), alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g. methylpolyisopropylene glycol ether having an average molecular weight of 1000, diphenyl ether of polyethylene glycol having a molecular weight of 500–1000, diphenyl ether of polypropylene glycol having a molecular weight of 1000–1500, etc.) or mono-and polycarboxylic esters thereof, for example, the acetic acid esters, mixed $C_3$–$C_8$ fatty acid esters, esters, or the $C_{13}$Oxo acid diester of tetraethylene glycol.

Another suitable class of synthetic oils comprises the esters of dicarboxylic acids (e.g. phthalic acid, succinic acid, alkyl succinic acids and alkenyl succinic acids, maleic acid, azelaic acid, suberic acid, sebacic acid, furmaric acid, adipic acid, linoleic acid dimer, malonic acid, alkyl malonic acids and alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxy-siloxane oils and silicate oils comprise another useful class of synthetic oils (e.g. tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)disiloxane, poly(methyl)siloxanes, poly(methylphenyl)siloxanes, etc.). Other synthetic oils include liquid esters of phosphorus-containing acids (e.g. tricresyl phosphate, trioctyl phosphate, diethyl ester of decylphosphonic acid, etc.) and polymeric tetrahydrofurans.

Unrefined, refined and rerefined oils (and mixtures of each with each other) of the type disclosed hereinabove can be used in the present invention. Unrefined oils are those obtained directly from a natural or synthetic source without further purification treatment. For example, a shale oil obtained directly from retorting operations, a petroleum oil obtained from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such refined oils are also known as reclaimed or reprocessed oils and often are additionally processed by techniques directed to removal of spent additives and oil breakdown products.

The zirconium salts which are useful as an additive in the compositions of the invention preferably are salts of carboxylic acids or mixtures of carboxylic acids. The preparation of zirconium salts or organic carboxylic acids is well known to those skilled in the art. Hence many of the zirconium salts have been described and used previously such as, for example, in drier systems. At times, such salts have been referred to in the art as soaps. The salts or soaps of zirconium can be prepared as normal or basic salts or soaps by varying the amount of metal reacted with the organic carboxylic acid and by other techniques used in the art to increase the amount of metal reacted with the carboxylic acid which results in overbased products.

The organic carboxylic acids used in the formation of the salts or soaps can be either natural or synthetic, aliphatic or aromatic acids or mixtures thereof. Examples of natural acids, although usually refined, include straight and branched chain carboxylic acids and mixtures such as tall oil acids and cyclic carboxylic acids such as naphthenic acids. A variety of synthetic carboxylic acids, and particularly aliphatic carboxylic acids or mixtures thereof are useful, and these generally contain six or more carbon atoms.

The metal salts or soaps can be prepared by fusion or precipitation methods. The soaps normally are prepared in an inert liquid medium such as a hydrocarbon oil or solvent. The organic carboxylic acids generally will have at least six carbon atoms and as many as 30 carbon atoms, but when more than one carboxylic acid is employed, carboxylic acids containing as little as two carbon atoms may be employed as one of the acids of the mixture. Examples of useful organic carboxylic acids include acetic acid, propionic acid, butyric acid, isopentanoic acid, hexoic acid, 2-ethylbutyric acid, nonylic acid, decanoic acid, 2-ethylhexoic acid, isooctanoic acid, isononanoic acid, neodecanoic acid, lauric acid, palmitic acid, tall oil acids, stearic acid, oleic acid, linoleic acid, naphthenic acid, etc. Mixtures of these acids with each other or the mixtures obtained after saponification of various oils can be employed in the preparation of the zirconium soaps. The basic salts or soaps are preferred since these contain higher amounts of zirconium, and those salts and soaps containing even higher metal content, often referred to as "overbased" are particularly useful in the invention. Accordingly, zirconium salts and soaps have been prepared and are known in the art containing various amounts of zirconium ranging from, for example, about 5% zirconium to about 30% zirconium or more. Useful zirconium soaps are described in, for example, U.S. Pat. Nos. 2,739,902 and 3,046,153.

Specific examples of the zirconium salts or soaps which are useful in the compositions of the invention include zirconium naphthenate, zirconium neodecanoate, zirconium tallate, zirconium 2-ethylhexoate, etc. Examples of zirconium salts of a mixture of acids such as salts disclosed in British Pat. No. 1,002,103, include zirconium naphthenate acetate (10% Zr); zirconium tallate propionate (10% Zr); zirconium tallate isobutyrate (60% Zr), etc. Mineral spirits solutions of zirconium salts are available from Mooney Chemicals, Inc., Cleveland, Ohio 44113 under the general trade designations TEN-CEM, CEM-ALL, NAP-ALL, HEX-CEM, LIN-ALL and NEO-NAP. The zirconium content of these available salts ranges from about 5% to about 18%. When desired, the mineral spirits may be stripped from the salt and replaced by the desired amount of oleaginous liquid of lubricating viscosity such as a mineral oil. Alternatively, the oleaginous liquid may be added to the mineral spirits solution and the mixture heated under vacuum to remove the mineral spirits.

In addition to the zirconium salts and soaps described above, the lubricating composition of the invention also contains at least one oil-soluble sulfur-containing extreme pressure agent containing up to about 25% combined sulfur. Any of the known types of organic sulfur compounds which have heretofore been suggested as being useful as extreme pressure agents may be used as a sulfur-containing agent in the invention. These include, organic sulfides and polysulfides, sulfurized oils and esters or fatty acids, thiocarbamates, thiophosphates and mixtures thereof. These sulfur compounds may contain other groups which are beneficial and these include halogen groups.

Examples of organic sulfides and polysulfides which are useful as EP agents include aliphatic and aromatic sulfides and polysulfides such as hexyl sulfide, octadecyl sulfide, butyl disulfide, amyl disulfide, hexyl disulfide, octadecyl disulfide, diphenyl sulfide, dibenzyl sulfide, dixylyl sulfide, diphenyl disulfide, dinaphthyl disulfide, diphenol disulfide, dibenzyl disulfide, bis(-chlorobenzyl) disulfide, dibenzyl trisulfide, dibutyltetrasulfide, sulfurized dipentene and sulfurized terpene. Halogenated derivatives of the above sulfides and polysulfides are useful and examples include the chlorinated and fluorinated derivatives of diethyl sulfide and disulfide, dioctyl sulfide, diamyl sulfide and disulfide, diphenyl sulfide and disulfide and dibenzyl sulfide and disulfide. A more exhaustive listing of sulfur and halogen EP agents which may be used is found in U.S. Pat. No. 2,208,163. Examples of sulfurized oils include sulfurized sperm oil, sulfurized methyl ester of oleic acid, sulfurized sperm oil replacements such as CEPAD 1051 available from Calber Chemical, Inc., Philadelphia, Pennsylvania 19134 containing about 10% sulfur, sulfurized sperm oil replacements available from Mayco Oil & Chemical Co., Inc., Pittsburgh, Pennsylvania under the general trade designation MAYSPERM and sulfurized natural sperm oil under the general trade designation MAYCO BASE, both of which contain about 11% sulfur. Other examples of sulfurized oils include sulfurized methyl linoleate, sulfurized animal and vegetable oils, sulfurized lard oil and sulfurized cottonseed oil.

Dialkyldithiocarbamates wherein the alkyl groups contain from about one to 10 carbon atoms or more are useful, and examples of such thiocarbamates include zinc dioctyl dithiocarbamate and zinc dihexyldithiocarbamate. An example of a useful aromatic thiocarbamate is barium heptylphenyl dithiocarbamate.

The oil-soluble sulfur-containing extreme pressure agent also may be a thiophosphate and more particularly, a dithiophosphate. Among the particularly useful dithiophosphates are the group II metal phosphorodithioates such as zinc dicyclohexylphosphorodithioate, zinc dioctylphosphorodithioate, barium di(heptylphenyl) phosphorodithioate, cadmium dinonylphosphorodithioate, and the zinc salt of a phosphorodithioic acid produced by the reaction of phosphorus pentasulfide with an equimolar mixture of isopropylalcohol and n-hexyl alcohol.

As mentioned above, mixtures of the above described sulfur-containing compounds may be used in the compositions of the invention, for example, a combination of a disulfide with a dithiocarbamate such as dibenzyl disulfide with a zinc dialkyldithiocarbamate may be used to provide a desired sulfur in the composition.

The compositions of the invention which are useful as lubricating compositions and functional fluids contain a major amount of an oleaginous liquid of lubricating viscosity and a minor amount of an additive combination comprising a mixture of at least one of the zirconium salts and at least one of the oil-soluble sulfur-containing EP agents described above. Generally, the compositions of the invention will comprise the oleaginous liquid with from about 1 to about 15% of the zirconium salt and from about 1 to about 10% by weight of the sulfur-containing agent. Preferably, the compositions of the invention have a zirconium content of from about 0.2 to about 1.0% by weight and a sulfur content of from about 0.3 to about 2.2% by weight. The mole ratio of sulfur compound to zirconium compound is from about 1:6 to about 1:1.

The invention also includes additive concentrates comprising said oleaginous liquid or a similar substantially inert, normally liquid organic diluent and the zirconium soap and oil-soluble sulfur-containing extreme pressure agents of the invention. Generally, the additive concentrate will comprise from about 5 to about 90% by weight of the zirconium salt, from about 5 to about 90% by weight of the sulfur-containing extreme pressure agent and from 0 to about 48% by weight of the oleaginous liquid. In one preferred embodiment, the additive composition contains a mole ratio of the sulfur compound to zirconium compound of from about 1:6 to about 1:1. Such additive concentrates may be further diluted, as is well known in the art, to produce lubricating compositions and other functional fluids.

The present invention also contemplates lubricating compositions and functional fluids and concentrates containing other additives in combination with the zirconium soap and sulfur-containing agents. Such additives include, for example, detergents and dispersants of the ash-containing or ashless type, corrosion- and oxidation-inhibiting agents, pour point depressing agents, viscosity index improvers, frictional modifiers, color stabilizers and anti-foam agents. These additional additives are well known in the art.

The ash-containing detergents may be exemplified by the oil-soluble neutral and basic salts of alkali or alkaline earth metals with sulfonic acids, carboxylic acids, or organic phosphorus acids characterized by at least one direct carbon-to-phosphorus linkage. Ashless detergents and dispersants are illustrated by the interpolymers of an oil-solubizing monomer, for example, decyl methacrylate, vinyl decyl ether, or high molecular weight olefins, with a monomer containing polar substituents such as aminoalkyl acrylate or poly-(oxyethylene)-substituted acrylate; the amine salts, amides, or imides of oil-soluble monocarboxylic or dicarboxylic acids such as stearic acid and high molecular weight alkyl or alkenyl-substituted succinic acid.

Other extreme pressure agents and corrosion-inhibiting and oxidation-inhibiting agents which may be included are exemplified by chlorinated aliphatic hydrocarbons such as chlorinated wax; phosphosulfurized hydrocarbons such as the reaction product of a phosphorus sulfide with terpentine or methyl oleate; phosphorus esters including principally dihydrocarbon and trihydrocarbon phosphites such as dibutyl phosphite, diheptyl phosphite, dicyclohexyl phosphite, distearyl phosphite; examples of suitable antioxidants which may be used in the compositions of the invention are the zinc, barium and calcium thiophosphates and compounds such as di-t-butyl-p-cresol, 2-naphthol and phenyl-1-naphtylamine. Suitable rust inhibitors are exemplified by the organic phosphites, polyhydric alcohols and sodium or calcium sulfonates. Suitable pour-point depressants are the polymethacrylates and polymers formed by the condensation of wax with naphthalene or phenols.

Examples of suitable viscosity index improvers are the polyisobutylenes, polymethacrylates and polyalkylstyrenes having a molecular weight of from about 5000 to about 20000. Exemplary of suitable foam inhibitors are the polyacrylates and methylsilicone polymers having a viscosity of from about 300 to 1000 cst. at 100° F.

The following examples illustrate the compositions and additive concentrates of the invention. Unless otherwise indicated, all parts and percentages are by weight.

Example A

A mixture of a zirconium salt of a synthetic mixture of $C_8$–$C_{13}$ carboxylic acids containing 18% zirconium and dibenzyl disulfide containing 25% sulfur is prepared in mineral oil (MC 150 bright stock oil from Gulf Oil Company) to provide a composition containing 0.44% zirconium and 0.25% sulfur.

Example B

A mixture of the zirconium salt of Example A with MAYSPERM 2011 containing 11% sulfur is prepared in the mineral oil described in Example A to provide a composition containing 0.44% zirconium and 0.25% of sulfur.

Example C

A mixture is prepared as in Example B except that the MAYSPRERM is replaced by an equivalent amount of CEPAD 1051 also containing 11% sulfur.

Example D

A mixture of the zirconium salt of Example A, dibenzyldisulfide containing 25% sulfur and zinc dialkyldithiocarbamate available from R. T. Vanderbilt Company, Inc. under the general trade designation VANLUBE AZ and containing 12.1% sulfur and 6.2% zinc is prepared in the mineral oil of Example A to provide a composition containing 0.44% zirconium and 0.34% sulfur.

Example E

This composition is similar to the composition of Example D except that the zirconium soap is a soap commercially available under the general trade designation Zirconium Nuxtra and containing 18% zirconium.

Example F

The composition of this example is similar to the composition of Example D except that the zirconium soap is a zirconium neodecanoate containing 18% zirconium.

Example G

The composition of this example is similar to the composition of Example D except that the zirconium soap is a zirconium neodecanoate containing 12% zirconium.

Example H

The composition of this example is similar to the composition of Example D except that the dithiocarbamate is replaced by zinc dioctylphosphorodithioate.

The efficiency of the compositions of this invention to impart load-carrying properties to lubricants is shown by the Timken OK Load test (ASTM D 2782) which measures the load at which the rupture of a film of the lubricant between the rotating cup and a stationary block, and the surface distress (e.g., scoring, abrasion) of the stationary block occur. Thus, the higher the load, the better the load-carrying properties of the lubricant. The results which are obtained with several of the above examples of the invention are reported in the following table along with the results obtained with several controls.

| Lubricant Example | %Zr | % S | Timken OK Load |
|---|---|---|---|
| Control-1 | 0 | 0 | 30 |
| Control-2 | 0 | 0.25 | 35 |
| Control-3 | 0 | 0.34 | 35 |
| Control-4 | 0.44 | 0 | 30 |
| Control-5 | 0 | 0.25 | 60 |
| A | 0.44 | 0.25 | 65 |
| B | 0.44 | 0.25 | 80 |
| C | 0.44 | 0.25 | 80 |
| D | 0.44 | 0.34 | 75 |
| E | 0.44 | 0.34 | 70 |
| F | 0.44 | 0.34 | 70 |

Control-1 Base oil only
Control-2 Base oil and dibenzyl disulfide
Control-3 Base oil, dibenzyl disulfide and zinc dialkyldithiocarbamate (Vanlube AZ)
Control-4 Base oil and zirconium soap of Example A
Control 5 Base oil, lead naphthenate (30% lead) and dibenzyl disulfide providing 1% Pb and 0.25% S added.

The embodiments of the invention in which an exclusive property or privilege is claimed are defined as follows:

1. A lubricating composition comprising a major proportion of an oleaginous liquid of lubricating viscosity and a minor amount of an additive composition comprising a mixture of
   (a) a zirconium salt of a carboxylic acid or mixture of carboxylic acids, and
   (b) at least one oil-soluble sulfur-containing extreme pressure agent containing up to about 25% combined sulfur.

2. The lubricating composition of claim 1 wherein the sulfur-containing agent comprises one or more organic polysulfides, sulfurized oils, thiocarbamates, thiophosphates or mixtures thereof.

3. The lubricating composition of claim 2 wherein the thiocarbamate is a dialkyl dithiocarbamate.

4. The lubricating composition of claim 2 wherein the thiophosphates are dialkyl dithiophosphates.

5. The lubricating composition of claim 1 wherein the composition comprises from about one to 15% of the zirconium salt and from about one to about 10% by weight of the sulfur-containing agent.

6. The composition of claim 1 wherein the sulfur-containing agent also contains a halogen.

7. The composition of claim 2 wherein the organic polysulfides are aromatic or aliphatic disulfides.

8. The composition of claim 7 wherein the disulfide is an aromatic disulfide.

9. The composition of claim 2 wherein the sulfur-containing agent is a mixture of an aromatic disulfide and a dialkyl dithiocarbamate.

10. The lubricating composition of claim 1 wherein the oleaginous liquid is a mineral oil.

11. The lubricating composition of claim 1 wherein the additive agent is a mixture of a zirconium salt of a mixture of carboxylic acid, and a sulfurized ester of a fatty acid.

12. The composition of claim 11 wherein the carboxylic acids contain from about six to 12 carbon atoms.

13. A lubricating composition comprising a major amount of an oleaginous liquid of lubricating viscosity, from about one to about 15% by weight of an oil-soluble zirconium salt of a carboxylic acid or mixture of carboxylic acids containing six to 12 carbon atoms, and from about one to about 10% by weight of one or more oil-soluble sulfur-containing extreme pressure agents containing up to about 25% combined sulfur.

14. The lubricating composition of claim 13 wherein the sulfur-containing agent is an organic polysulfide, a sulfurized oil, a dialky dithiocarbamate, a dialkyl dithiophosphate, or mixtures thereof.

15. The lubricating composition of claim 14 wherein the organic polysulfide is an aromatic disulfide.

16. The lubricating composition of claim 14 wherein the sulfurized oil is a sulfurized ester of a fatty acid.

17. The lubricating composition of claim 13 wherein the composition has a zirconium content of from about 0.2 to about 1.0% by weight and a sulfur content of from about 0.3% to about 2.2% by weight.

18. The composition of claim 13 wherein the oleaginous liquid is a mineral oil or a synthetic oil.

19. An additive concentrate composition comprising (a) from about five to about 90% by weight of an oil-soluble zirconium salt of a carboxylic acid or mixture of carboxylic acids, (b) from about five to about 90% by weight of an oil-soluble sulfur-containing extreme prssure agent containing up to about 25% by weight of combined sulfur, and (c) from about zero to about 48% by weight of an oleaginous liquid.

20. The additive composition of claim 19 wherein the zirconium salt is a salt of a monocarboxylic acid containing from about six to 12 carbon atoms.

21. The additive composition of claim 19 wherein the sulfur-containing agent comprises one or more organic polysulfides, sulfurized oils, dialkyl dithiocarbamates, dialkyl dithiophosphates, or mixtures thereof.

22. The additive composition of claim 19 wherein the mole ratio of the sulfur compound to zirconium compound is from about 1:6 to about 1:1.

* * * * *